US005797737A

United States Patent [19]

Le Gal et al.

[11] Patent Number: 5,797,737

[45] Date of Patent: Aug. 25, 1998

[54] CATALYTIC COMBUSTION SYSTEM WITH MULTISTAGE FUEL INJECTION

[75] Inventors: Jean-Hervé Le Gal, Paris; Gérard Martin; Patrick Euzen, both of Rueil-Malmaison, all of France

[73] Assignee: Institute Francais du Petrole, Rueil-Malmaison, France

[21] Appl. No.: 783,091

[22] Filed: Jan. 14, 1997

[30] Foreign Application Priority Data

Jan. 15, 1996 [FR] France ..... 96 00512

[51] Int. Cl.[6] ..... F23D 21/00

[52] U.S. Cl. ..... 431/170; 60/723; 431/7

[58] Field of Search ..... 431/7, 350, 353, 431/8, 170; 60/723

[56] References Cited

U.S. PATENT DOCUMENTS

| | | | |
|---|---|---|---|
| 4,926,645 | 5/1990 | Iwai et al. | 60/723 |
| 5,170,624 | 12/1992 | Cornelison et al. | 60/300 |
| 5,378,142 | 1/1995 | Kennelly et al. | 431/7 |
| 5,395,235 | 3/1995 | Aung | 60/723 |

FOREIGN PATENT DOCUMENTS

| | | | |
|---|---|---|---|
| 7722 | 1/1984 | Japan | 60/723 |
| 195215 | 8/1986 | Japan | 60/723 |

*Primary Examiner*—Carroll B. Dority

*Attorney, Agent, or Firm*—Antonelli, Terry, Stout & Kraus, LLP

[57] ABSTRACT

The present invention relates to a catalytic combustion system comprising a casing (1) having an inlet (2) for an oxidizer such as air, several fuel injection means (3, 5; 7) intended for a multistage fuel injection, and at least a first monolithic element (4) that may be covered with a combustion catalyst and situated downstream from a first fuel injection means (3) in relation to the direction of progress of an air-fuel mixture in the system, said first injection means performing a partial fuel injection, and comprising at least a second monolithic element (6) situated downstream from a second injection means (5), said second monolithic element (6) being intended to stabilize the combustion. The second monolithic element (6) can be covered with a combustion catalyst.

16 Claims, 5 Drawing Sheets

CATALYTIC COMBUSTION SYSTEM WITH MULTISTAGE FUEL INJECTION

FIELD OF THE INVENTION

The present invention relates to a catalytic combustion system with multistage fuel injection and using a non-selective oxidation catalyst.

BACKGROUND OF THE INVENTION

Conventional combustion achieved in the presence of a flame, commonly used in combustion processes intended for hydrocarbons such as natural gas, is a process that is difficult to control. It takes places in a well-defined air-hydrocarbon concentration range and leads, besides the formation of carbon dioxide and of water, to the production of pollutants such as carbon monoxide and nitrogen oxides.

Because of the increasingly stringent environmental limitations relative to pollutants (nitrogen oxides, unburned hydrocarbons, carbon monoxide) discharged by combustion processes, it is necessary to find new technologies allowing to greatly reduce these emissions. Several conventional solutions are well-known to the man skilled in the art:

- selective exhaust gas reduction (SCR): thus, the selective reduction of nitrogen oxides by ammonium hydroxide allows $NO_x$ contents to be reduced to about 10 ppm. However, this solution requires a particular reactor, storage and use of ammonium hydroxide; the installation and operating costs of such a system are therefore high;
- water or steam injection: such an injection lowers the temperature reached by the combustion gases, thus reducing significantly the $NO_x$ contents to about 50 ppm. The cost brought about by the addition of such a device is low. However, the operating costs of such an installation are high notably because of the purification of the water prior to the injection; besides, the over-consumption of fuel due to an energy efficiency decrease also raises the operating cost. Furthermore, although the water injection is sufficient to pass the current standards, it will not allow to comply with future $NO_x$ standards;
- a lean-mixture primary zone: this technology is based on the improvement of the air-fuel mixture homogeneity. It allows to bring the $NO_x$ emissions down to about 50 ppm, but this decrease is obtained to the detriment of the carbon monoxide and unburned hydrocarbon emissions that are increased.

Catalytic combustion is an attractive solution for meeting increasingly stringent pollutant limitation standards. In fact, the catalytic combustion chamber advantageously replaces conventional burners because it allows better total oxidation control in a wide range of the air-hydrocarbon ratio values, thus greatly reducing nitrogen oxides, unburned hydrocarbons and carbon monoxide emissions. It should also be mentioned that it allows to burn a very great variety of compounds.

As described notably by D. Reay in "Catalytic Combustion: Current Status and Implications for Energy Efficiency in the Process Industries—Heat Recovery Systems & CHP", 13, No 5, pp. 383–390, 1993, and by D. Jones and S. Salfati in "Rev. Gen. Therm. Fr." No 330–331, pp. 401–406, June–July 1989, catalytic combustion has many applications: radiant panels and tubes, catalytic stoves, gas turbines, cogeneration, burners, catalytic sleeves for steam reforming tubes, production of hot gases in the field of direct contact heating and catalytic plate reactors.

Concerning catalytic combustion systems used in the fields of energy production and of cogeneration, the commonest reactor configuration is a reactor comprising several catalytic zones: the entry catalyst(s) being more specifically intended to trigger the combustion reaction, the others serving to stabilize the combustion reaction at high temperature; the number of catalytic stages (or zones) being adjusted according to the conditions imposed by the application considered.

Combustion catalysts are generally prepared from a monolithic substrate made of ceramic or metal, on which a fine support layer consisting of one or more heat-resisting oxides whose surface and porosity are greater than that of the monolithic substrate is deposited. The active phase mainly consisting of metals from the platinum group is dispersed on this oxide.

As it is well-known to the man skilled in the art, platinum group metals exhibit the highest catalytic activity for the oxidation of hydrocarbons and thus trigger the combustion at a lower temperature than transition metal oxides. They are therefore preferably used in the first catalytic zones. However, because of the high temperatures reached either during starting phases or in the steady state, these catalysts suffer a degradation that reduces their catalytic performances. The fritting of the alumina-based support and the fritting of the active metal phase and/or its encapsulation by the support are causes that are commonly mentioned to explain this degradation.

It is well-known that the specific surface drop of alumina-based supports can be effectively stabilized by means of a suitable dope. Rare earths and silica are often mentioned as some of the most effective alumina stabilizers. Catalysts prepared according to this technique are described, among others, in patent U.S. Pat. No. 4,220,559. In this document, the catalyst comprises platinum group metals or transition metals deposited on alumina, an oxide of a metal selected from the group made up of barium, lanthanum and strontium, and an oxide of a metal selected from the group made up of tin, silicon, zirconium and molybdenum.

Besides, in order to limit the fritting of the active metal phase, it has been proposed to add various stabilizers notably based on transition metal oxides as described, for example, in patent U.S. Pat. No. 4,857,499.

Among the documents representative of combustion reactors comprising several catalytic zones, the following can notably be cited:

- European patent application EP-A-198,948 that describes a first catalytic zone: Pd and Pt and NiO; and a second catalytic zone: Pt and Pd;
- Japanese patent application JP-A-04/197,443 that describes a first catalytic zone: Pd and/or Pt; a second catalytic zone: $Sr_{0.8}La_{0.2}MnAl_{11}O_{19-\alpha}$; and a third catalytic zone: $Sr_{0.8}La_{0.2}MnAl_{11}O_{19-\alpha}$;
- international patent applications WO-A-92/9,848 and WO-A-92/9,849 show a first catalytic zone: Pd and (Pt or Ag); a second catalytic zone: Pd and (Pt or Ag); and a third catalytic zone: perovskite $ABO_3$ or oxide of a metal from group V(Nb or V), group VI (Cr) or group VIII (Fe, Co, Ni).

The critical point of the known multistage processes lies in the temperature control within the various catalytic stages. In case of a combustion reaction runaway, the temperature of the catalyst can quickly reach the adiabatic flame temperature. However, it is important to cover the whole load range of the gas turbine. From the ignition process to idle run and full load, the air-fuel ratio can vary in large proportions. Using such a catalytic combustion chamber can thus be delicate.

American patent U.S. Pat. No. 4,731,989 by Furuya et al. describes a combustion process whose main characteristic is a multistage fuel injection. The associated system referred to as "hybrid" consists of a catalytic zone where a fuel fraction is burnt, this catalytic zone being followed by a homogeneous phase post-combustion zone where the rest of the fuel is mixed with the hot gases leaving the catalyst and is burnt in the form of a premixed flame. The air-fuel ratio of the mixture entering the catalytic zone is so adjusted that the adiabatic temperature of the gases does not exceed about 1000° C. at the outlet of this catalytic zone. The rest of the mixture is injected downstream from the catalytic zone in order to reach a combustion gas temperature compatible with the requirements of current combustion processes, i.e. 1200° C. to 1500° C. Because of the limitation of the material temperatures to 1000° C., the catalyst suffers no deactivation.

This process is interesting insofar as it provides a greater safety than processes where the temperature is controlled only through the geometry of the monolith or of the monoliths. It is also more flexible during starting phases.

However, more recently, in an article by Furuya et al. "A study on combustion catalyst for gas turbine", Second Tokyo Conference on Advanced Catalytic Science and Technology (TOCAT), Tokyo, 21–26 Aug. 1994, I.38, pp. 129–130, the authors mention that the catalytic activity of a palladium-based catalyst fluctuates between 800° C. and 1000° C. because of the equilibrium as follows: PdO Pd+½ $O_2$. This unstable behaviour of palladium is observed during operation in such a combustion reactor with multistage injection; Furuya et al. add that, if this instability problem of palladium-based formulations can be solved, a palladium-based catalyst will be particularly well-suited for this multistage injection process.

A global approach to catalytic combustion, taking account of both the advantages and the drawbacks of the catalytic reactor configuration and the catalytic formulation, therefore becomes necessary.

Furthermore, the problem of non-multistage combustion where the fuel is injected in a single place (upstream from the catalytic stage or stages) is that the walls of the reactor then reach the adiabatic flame temperature; this quickly leads to a deactivation of the catalyst.

In order to avoid these high temperatures, multistage catalytic combustion processes and systems comprising splitting up the fuel injection (or multistage injection) have already been proposed. Thus, patent U.S. Pat. No. 4,731,989 mentioned above can appear to be a solution to this problem. However, the drawback mentioned above concerning the behaviour of palladium can lead to a complete deactivation thereof.

Besides, the catalyst deterioration observed poses the problem of the light-off shift. The reliability of the process is thus questioned.

SUMMARY OF THE INVENTION

The object of the present invention is thus a catalytic combustion system comprising a casing having an inlet for an oxidizer such as air, several fuel injection means intended for a multistage fuel injection and at least a first monolithic element that can be covered with a combustion catalyst placed downstream from a first fuel injection means in relation to the direction of progress of an air-fuel mixture in the system, said first injection means performing a partial fuel injection.

According to the invention, said system further comprises a second monolithic element situated downstream from a second injection means, said second monolithic element being intended to stabilize the combustion. The second monolithic element can be covered with a combustion catalyst such as a hexa-aluminate.

According to the invention, the first or the second monolith can comprise a plurality of elementary monoliths covered with catalysts based on precious metals.

The amount of fuel delivered by the second injection means is such that the adiabatic flame temperature does not exceed 1100° C. Besides, the amount of fuel delivered by the first injection means is such that the adiabatic flame temperature does not exceed 900° C.

Furthermore, the first monolithic element is such that the catalyst with which it is covered can withstand temperatures below 900° C. and that the temperature of the gases at the outlet of the first monolithic element is below about 800° C.

The second monolithic element is such that the catalyst with which it is covered can withstand temperatures below 1100° C. and that the temperature of the gases at the outlet of the second monolithic element is below 1000° C.

According to an embodiment of the invention, the catalytic combustion system comprises a third monolithic element placed downstream from the second monolithic element, with a third fuel injection means situated between the second and the third monolithic element.

Advantageously, said catalyst mainly consists of a formula described by the claimant in French patent application FR-A-2,721,837, said formula being as follows: $A_{(1-x)}B_yC_zAl_{(12-y-z)}O_{(19-d)}$ where A represents at least one element of valence X selected from the group made up of barium, strontium and rare earths; B represents at least one element of valence Y selected from the group made up of Mn, Co and Fe, C represents at least one element selected from the group made up of Mg and Zn; the value of x ranging from 0 to 0.25, the value of y ranging from 0.5 to 3 and the value of z ranging from 0.01 to 3; the maximum value of the sum y+z is 4 and d has a value, determined as a function of the respective valences X and Y of elements A and B and of the value of x, y and z, that is equal to $1-\frac{1}{2}\{(1-x)X+yY-3y-z\}$.

In particular, the catalyst covering the first monolithic element comprises palladium oxide.

More precisely, the catalyst covering the first monolithic element can comprise a heat-resisting oxide support and an active phase comprising in percent by weight in relation to said support: 0.3 to 20% cerium, 0.01 to 3.5% iron and 1 to 10% of at least one element selected from platinum and palladium.

According to the invention, the casing is mainly cylindrical, the oxidizer inlet and the first injection means being situated at one of its ends on a cross-section, said second and/or third injection means opening longitudinally into said cylinder.

At least one of the monolithic elements can be annular; for example, the first and the second monolithic element can be annular.

Without departing from the scope of the invention, at least one of the monolithic elements is cylindrical and occupies all of the cross-section of said cylinder.

According to an embodiment, all the monolithic elements are cylindrical.

According to another embodiment of the invention, the annular monolithic elements are arranged concentrically between an end disk equipped with the oxidizer and fuel inlets and a bottom allowing the gases to flow out, the inlet disk exhibiting a greater surface than the bottom, so that the motion of the gases in said cylinder is mainly radial.

BRIEF DESCRIPTION OF THE DRAWINGS

Other features, advantages and details of the invention will be clear from reading the description hereafter, given by way of non limitative examples, with reference to the accompanying drawings in which.

DESCRIPTION OF THE INVENTION

Figure 1:
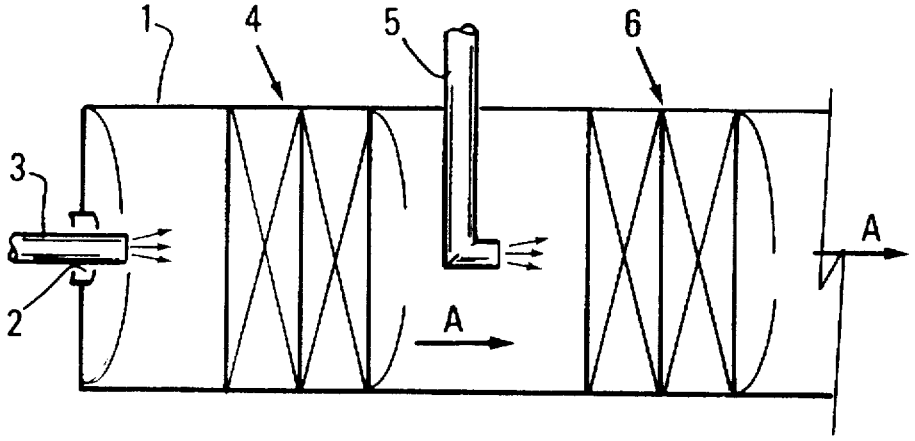
FIG. 1 is a simplified longitudinal section of a first embodiment of the invention.

According to FIG. 1, a casing 1 has an inlet 2 through which a first combustive fluid (air in this case) and a fuel are introduced via a first injection means 3. The first injection means 3 allows to inject only part of the fuel necessary for total combustion.

A first monolithic element 4 is placed downstream from the first injection means 3 in relation to the direction of progress of the fluids in casing 1 shown by arrows A.

The monolithic element can comprise n parts (or sections) spaced out in relation to each other or not. The substrate of the monolith can be made of ceramic or metal, and have a honeycomb geometry. The substrate can be covered with a catalytic layer made of precious metals such as palladium.

The first monolithic element 4 thus allows a progressive temperature increase of the gas flowing therethrough and of the catalytic layer. Only a fraction of the fuel is burned there.

A second fuel injection means 5 intended to inject, according to this embodiment of the invention, the rest of the fuel necessary for the total combustion is situated downstream from the first monolithic element.

Furthermore, a second monolithic element 6 is placed downstream from the second fuel injection means 5. The second monolithic element 6 can comprise m parts (or sections) spaced out in relation to each other or not. The substrate can be made of ceramic or metal and be covered with a catalytic layer preferably consisting of hexa-aluminates. The catalyst of the second monolithic element must withstand temperatures that can reach 1100° C. in order to be able to bring the gases flowing through the second monolith to their self-ignition temperature, i.e. about 1000° C.

With this configuration of the second monolith, the combustion light-offs (at the level of the first monolith) are then of the order of 700° C., almost always at a temperature above 600° C.

Thus, the first catalytic stage must be preferably such that the temperature of the gases at the outlet thereof ranges between 650° C. and 800° C. According to a preferred embodiment of the invention, the catalyst used in the first monolithic element 4 comprises palladium oxide. Knowing that the latter is reduced to metallic palladium above about 900° C. (a value that varies with the pressure), the fuel flow rate is so adjusted at 3 that the deposited catalyst temperature is below about 900° C. in order to prevent transformation of the palladium oxide. It will simultaneously be tried not to reach self-ignition in monolith 4; thus, the temperature of the gases at the outlet of said monolith must be below about 800° C.

More precisely, the catalyst that covers the first monolithic element comprises a heat-resisting oxide support and an active phase comprising in percent by weight in relation to said support: 0.3 to 20% cerium, 0.01 to 3.5% iron and 1 to 10% of at least one element selected from platinum and palladium.

This catalyst has been described in the patent application EN.94/13,739 filed by the applicant.

Figure 2:
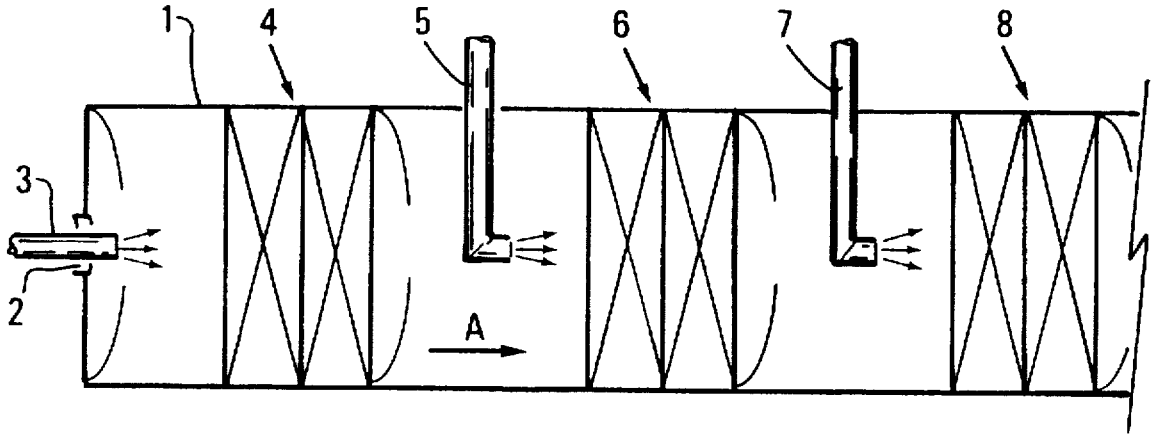
FIG. 2 is a simplified longitudinal section of a second embodiment of the invention.

According to another embodiment of the invention, illustrated by FIG. 2, the second combustion stage 5, 6 is followed (in relation to the direction of progress of the gases in casing 1) by a third combustion stage.

More precisely, a third fuel injection means 7 is then placed behind the second monolithic element 6. A third monolithic element 8 that is preferably not coated with catalyst is placed downstream from the third fuel injection means.

The third combustion stage thus defined is mainly intended to stabilize the combustion when the second monolithic element 6 is itself covered with catalyst.

Comparative examples are given hereafter in order to show the differences between the prior art and the present invention, and the advantages following therefrom.

EXAMPLE 1 (PRIOR ART)

The monolithic element shown here consists of three ceramic monoliths of honeycomb structure, of a density of 350 cells/inch$^2$, i.e. about 54 cells/cm$^2$, juxtaposed in a casing. The walls of the monoliths channels are about 0.14 mm thick. Each monolith is 5 cm long and 20 cm in diameter. The first monolith is covered with a catalyst based on palladium oxide on stabilized alumina, the other two monoliths being covered with a hexa-aluminate.

The air that flows onto the first monolith is preheated to 380° C. at a pressure of 15 bars. The fuel totally injected upstream from the first monolith is natural gas (composition example: 98% $CH_4$, 2% $C_2H_6$), so that the air-fuel ratio is equal to 0.4. The flow of air entering the combustion system is 2880 kg/h. The flow of natural gas is 67 kg/h.

Figure 3:
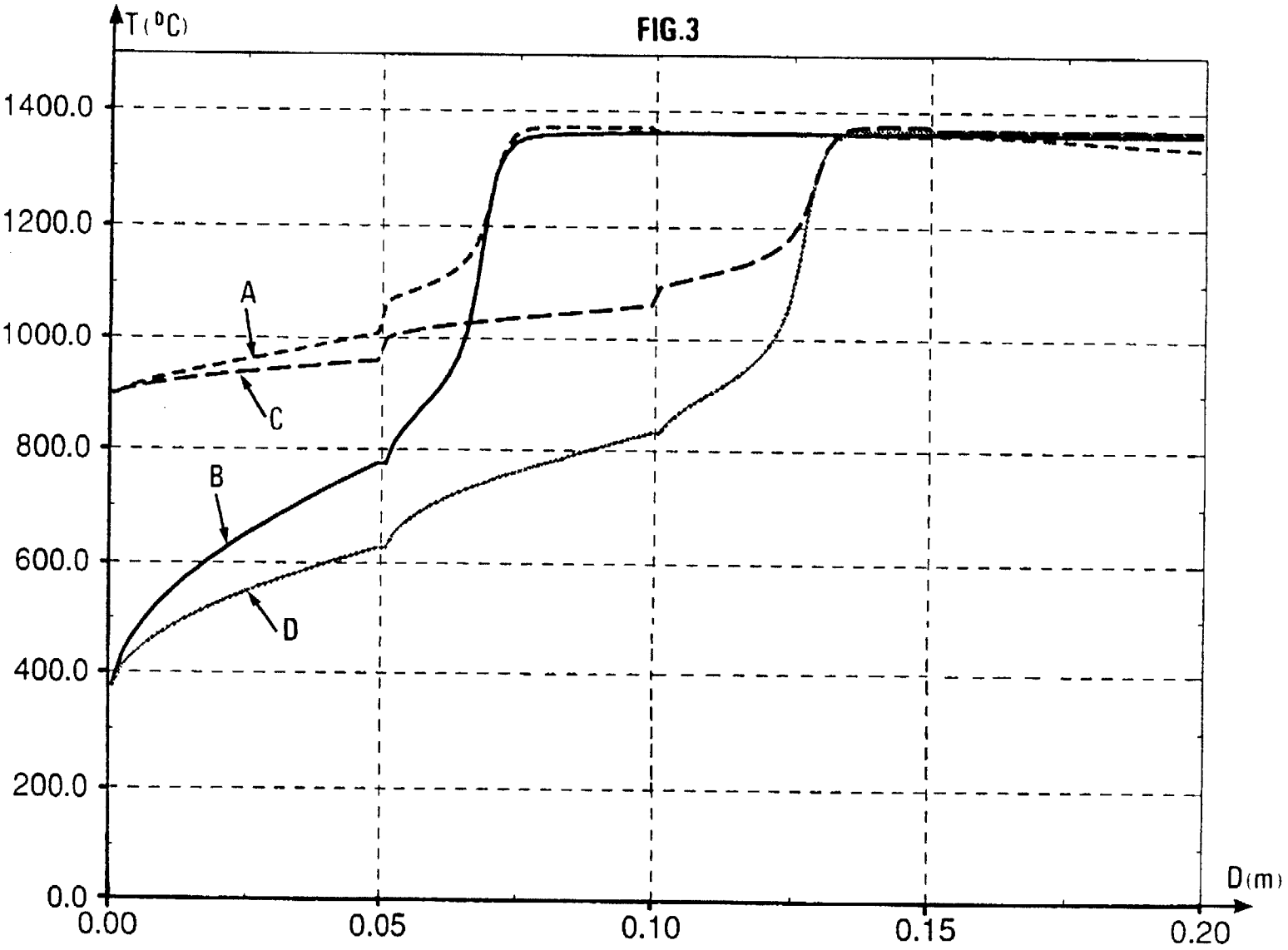
FIGS. 3 and 4 show temperature curves at different points of reactors according to the prior art.

FIG. 3 shows the axial gas and substrate temperature profiles for this example.

Curves B and D relate to the temperatures of the mixture flowing through the monoliths: between 0 and 0.05 m in the first monolith; between 0.05 and 0.10 m in the second monolith, and between 0.10 and 0.15 m in the third monolith.

Curves A and C give the temperatures of the substrate, i.e. of the catalyst and of the support, through the three monolith sections mentioned above.

Curves A and B will be analyzed first:

Curve A shows in fact that the temperature of the substrate is still above 900° C., which will lead to the deactivation of the monolith catalyst by the transformation $PdO \rightarrow Pd + \frac{1}{2} O_2$.

Curve A shows that the temperature of the substrate is above 900° C. This leads to the decomposition of the palladium oxide that constitutes the active phase of the catalyst into metallic palladium, markedly less active, and consequently to the fast drop in the methane conversion.

On the other hand, the temperatures of the substrate in the second monolith (axial distance ranging between 0.05 and 0.10 m) are above 1350° C.; this will lead to the deactivation of the catalyst of the second and third monoliths.

Besides, after 50 hours of operation under such conditions, the light-off of the system has passed from 290° C. to 450° C., which means that the catalyst can no longer be promoted under the operating conditions of a turbine.

A solution for reducing the temperature of the catalyst could have been to vary the velocity of the air at the combustion system inlet (for example by reducing the diameter of the chamber). Curves C and D show that, by multiplying the velocity of the air by 4, no significant variation of the substrate temperature, notably at the level of the first monolith, can be obtained. This solution should therefore not be retained, all the more so since it considerably increases the pressure drops (×16) to a non-realistic level.

EXAMPLE 2 (PRIOR ART)

Figure 4:
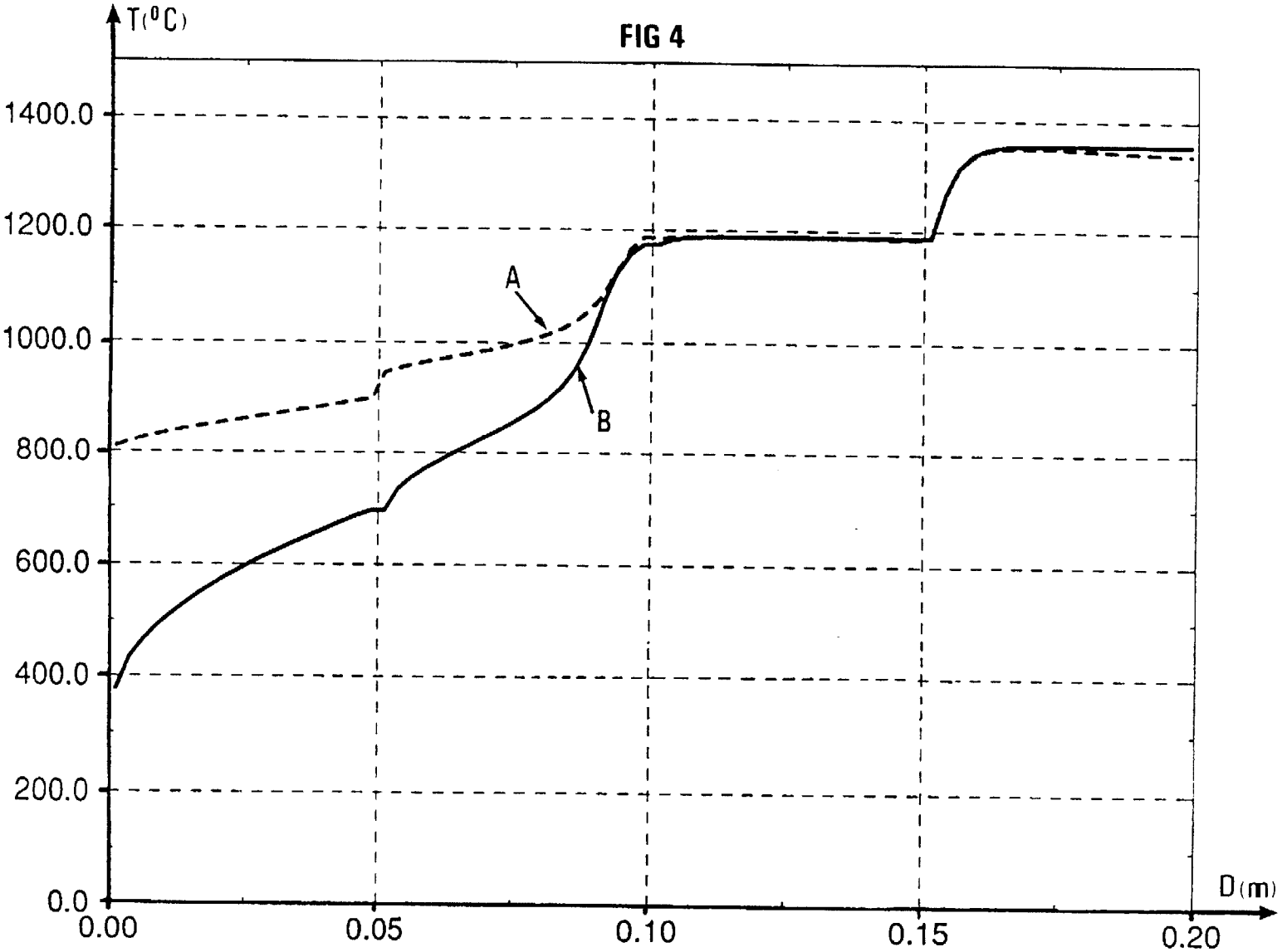

In this example, illustrated by FIG. 4, the operating conditions are the same as in example 1. However, the layout of the combustion chamber is different. It still consists of three monoliths identical to those described in example 1, but all of the fuel is not injected at the reactor inlet. Part of the fuel, i.e. 55 kg/h here, is injected before the first monolith, and the remaining 12 kg/h are injected directly downstream from the third and the last monolith section.

Curve A shows that the conversion is self-regulated in monoliths 4 and 6 since the temperature is above 900° C. therein.

The fuel complement injected into the hot gases at the reactor outlet allows to obtain self-ignition of the mixture and therefore a complete conversion.

However, as in example 1, after 50 hours of operation, monoliths 4 and 6 have deteriorated and the system allows the conversion of only 30% of the fuel injected by the first injector. At the time of the second injection, the temperature of the fumes is not high enough to allow self-ignition of the mixture.

The same drawback as in example 1 remains.

EXAMPLE 3 (ACCORDING TO THE INVENTION)

Figure 5:
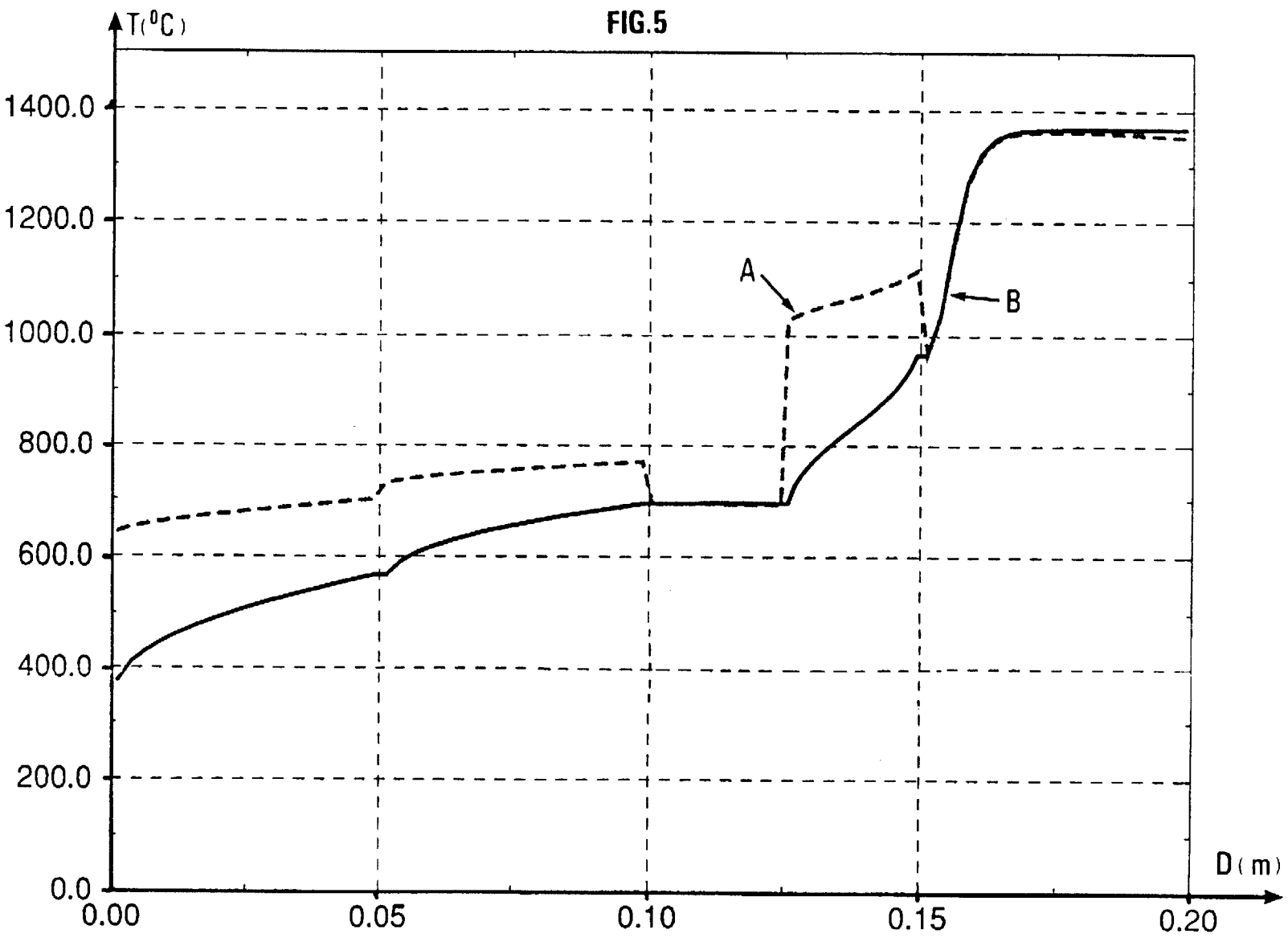
FIG. 5 shows temperature curves at different points of the embodiment of the invention illustrated by FIG. 2.

In this example, illustrated by FIG. 5, the operating conditions are identical to those of the previous two examples. The combustion chamber consists of two monolithic elements. The first one comprises two 5-cm long monolith sections coated with a catalyst based on palladium oxide (and having the same cell density). The system then exhibits a 2.5-cm space into which fuel is injected, then a second 2.5-cm long monolith covered with a catalyst of the hexa-aluminates family; FIG. 1 illustrates such a structure.

Fuel injection is split in two: 33.5 kg/h, i.e. half the fuel, is injected upstream from the first catalyst section, and the rest is injected before the last section.

According to the invention, the minimum injection at each monolithic stage (or section) is about 20% of the total feedstock. This allows mixing of the fuel with air or the fumes to be achieved more readily.

In relation to the previous systems, the improvement observed relates to the temperature of the substrate, that does not exceed 900° C. in the first two sections. Similalry, in the last section, the temperatures do not exceed 1100° C., which is the maximum temperature that hexa-aluminates can withstand without considerable deactivations. Combustion is completed in the homogeneous phase directly downstream from the last section. Under such conditions, the system has been operated for 400 hours with no significant catalyst deactivation or light-off variation.

Thus, by lowering significantly the temperatures of the monoliths, the present invention allows to preserve their integrity. Besides, the catalytic combustion that can only take place at temperatures below 900° C. is thus achieved in almost all the monoliths according to the invention.

Figure 6:
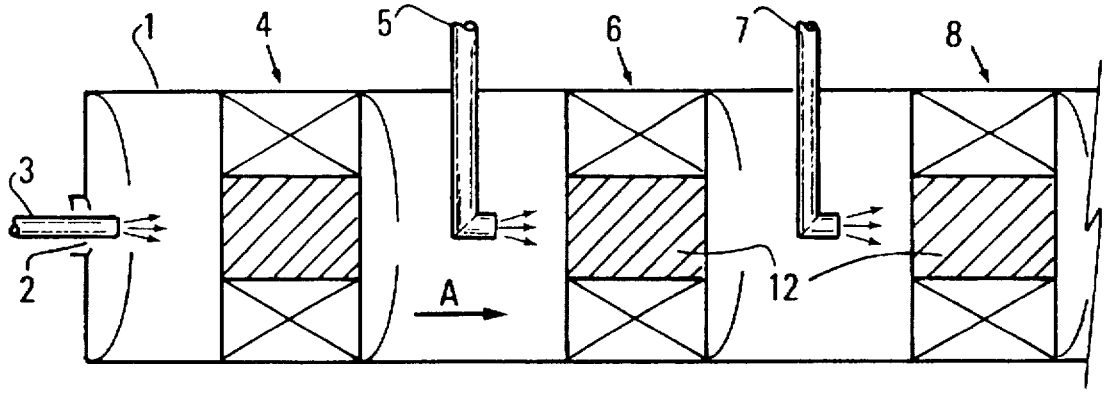
FIG. 6 is a simplified longitudinal section of another embodiment of the invention, and FIGS. 7A and 7B respectively illustrate, by means of a longitudinal section and of a radial section, yet another embodiment of the invention.

FIG. 6 relates to an embodiment of the invention that differs from that of FIG. 2 only in the shape of the first two monoliths 4 and 6: instead of being cylindrical, they are annular, with a central zone 12 preventing flows. This allows a different path of the mixture, which will be preferred if the reactor is to be used under operating conditions different from those of FIG. 2.

Figure 7A:
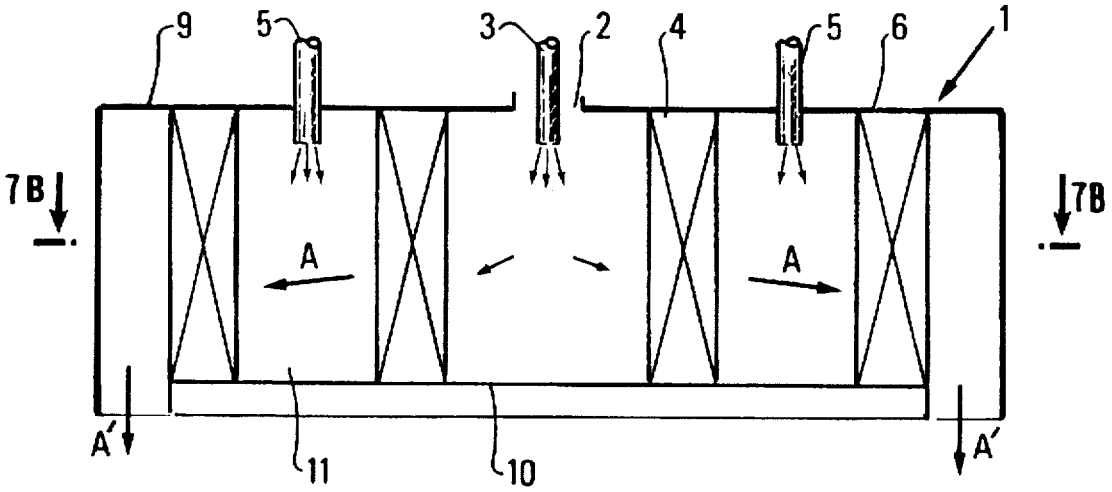
Figure 7B:
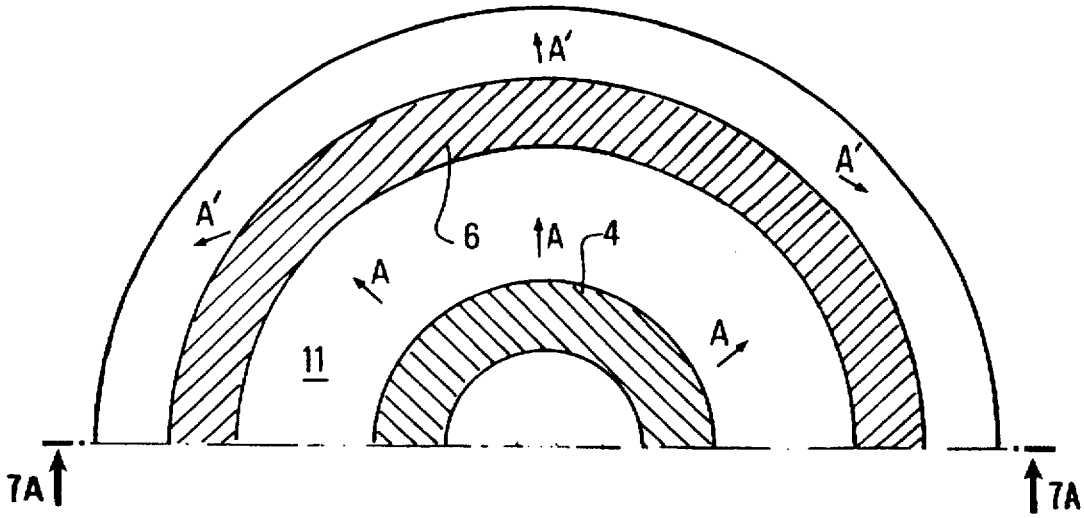

Finally, FIGS. 7A and 7B show an embodiment of the invention according to which the first and the second monolithic elements 4 and 6 are both annular, concentric and radially crossed by the air-fuel mixture. More precisely, casing 1 is a cylinder of low height in relation to its diameter. The air inlet is situated on inlet disk 9, near to the axis of said cylinder, as well as the first injection means 3. The monolithic elements are arranged concentrically between the two end disks (9, 10) of cylinder 1. Inlet disk 9 has a greater surface than bottom 10.

Thus, the air-fuel mixture is radially diverted through the first annular monolithic element 4. The second injection means 5 comprises here several injection means opening into the annular space 11 delimited by the first monolithic element 4 and the second monolithic element 6.

As in the embodiments described above, injection means 5 allow to complete the combustion. Similarly, the second monolithic element 6 allows to stabilize the combustion.

Downstream from the second monolith, the gaseous mixture leaves the cylindrical casing 1 as shown by arrows A' in FIG. 7A, i.e. at the end opposite inlet 2; this is possible because bottom 10 covers the second monolithic element 6 and inlet disk 9 has a greater surface than bottom 10.

This embodiment of the invention will be preferably selected when size problems prevent from selecting the embodiments described in connection with FIGS. 1 to 6.

We claim:

1. A catalytic system comprising a casing having an inlet for an oxidizer, at least two fuel injection means intended for a multistage fuel injection, at least a first monolithic element that is covered with a first combustion catalyst and placed downstream from a first fuel injection means in relation to the direction of progress of an air-fuel mixture in the system, said first injection means performing a partial fuel injection, and at least a second monolithic element placed downstream from a second injection means, said second monolithic element being intended to stabilize the combustion, said second monolithic element being covered with a second combustion catalyst comprising a compound selected from hexa-aluminates.

2. A system as claimed in claim 1, comprising a third monolithic element placed downstream from said second monolithic element and third fuel injection means is situated between the second and the third monolithic element.

3. A system as claimed in claim 1, wherein the first or the second monolithic element further comprise a plurality of elementary monoliths covered with catalysts based on precious metals.

4. A system as claimed in claim 1, wherein the second catalyst that covers said second monolithic element can withstand temperatures below about 1100° C. and the temperature of the gases at the outlet of the second monolithic element is below about 1000° C.

5. A system as claimed in claim 4, wherein said first catalyst comprises a compound having a formula $A_{(1-x)}B_yC_zAL_{(12-y-z)}O_{(19-d)}$, where A represents at least one element of valence X selected from the group made up of barium, strontium and rare earths; B represents at least one element of valence Y selected from the group made up of Mn, Co and Fe; C represents at least one element selected from the group made up of Mg and Zn; the value of x ranges from 0 to 0.25, the value of y ranges from 0.5 to 3 and the value of z ranges from 0.01 to 3; the maximum value of the sum y+z is 4 and d has a value which, determined as a function of the respective valences X and Y of elements A and B and of the value of x, y and z, is equal to $1-\frac{1}{2}\{(1-x)X+yY-3y-z\}$.

6. A system as claimed in claim 1, wherein the first catalyst covering the first monolithic element comprises palladium oxide.

7. A system as claimed in claim 6, wherein said first catalyst comprises a heat-resisting oxide support and an active phase comprising in percent by weight in relation to said support: 0.3 to 20% cerium, 0.01 to 3.5% iron and 1 to 10% of at least one element selected from platinum and palladium.

8. A system as claimed in claim 1, wherein the first catalyst that covers the first monolithic element can withstand temperatures below about 900° C. and the temperature of the gases at the outlet of said first monolithic element is below about 800° C.

9. A system as claimed in claim 1, wherein the casing is substantially cylindrical, the inlet intended for the oxidizer and the first injection means is situated at one of its ends on a cross-section, and at least one of said second and third injection means opens longitudinally into said cylinder.

10. A system as claimed in claim 9, wherein at least one of the monolithic elements is an annular monolithic element.

11. A system as claimed in claim 9, wherein at least one of the monolithic elements is cylindrical and occupies all of the cross-section of said cylinder.

12. A system as claimed in claim 10, wherein all of the monolithic elements are cylindrical.

13. A system as claimed in claim 9, wherein the first monolithic element and the second monolithic element are annular monolithic elements.

14. A system as claimed in claim 2, wherein the third monolithic element is cylindrical.

15. A system as claimed in claim 10, wherein the annular monolithic elements are arranged coaxially between an end disk equipped with an oxidizer and fuel inlets and a bottom allowing the gases to flow out, and an inlet disk exhibits a greater surface than the bottom so that the motion of the gases in said cylinder is substantially radial.

16. A system as claimed in claim 1, wherein the oxidizer is air.

* * * * *